United States Patent [19]

Nishiyama

[11] Patent Number: 4,782,988

[45] Date of Patent: Nov. 8, 1988

[54] APPARATUS FOR FEEDING A SURFACE TYPE FASTENER TAPE OR THE LIKE ALONG A PREDETERMINED PATH

[75] Inventor: Hissai Nishiyama, Toyama, Japan

[73] Assignee: Yoshida Kogyo K. K., Tokyo, Japan

[21] Appl. No.: 926,211

[22] Filed: Nov. 3, 1986

[30] Foreign Application Priority Data

Nov. 1, 1985 [JP] Japan ..... 60-167518[U]

[51] Int. Cl.[4] ..... B65H 20/02; B65H 23/06; B65H 59/18

[52] U.S. Cl. ..... 226/52; 226/87; 226/190; 226/195; 242/155 R

[58] Field of Search ..... 226/87, 52, 190, 195, 226/76; 242/155 R; 26/2 R, 31

[56] References Cited

U.S. PATENT DOCUMENTS

| | | | |
|---|---|---|---|
| 2,287,768 | 6/1942 | Eckstein | 226/191 X |
| 2,785,042 | 3/1957 | Grajeck et al. | 26/2 R |
| 3,191,258 | 6/1965 | Spencer | 26/2 R |
| 3,484,099 | 12/1969 | Gallagher | 226/191 X |
| 3,615,990 | 7/1969 | Butler | 26/2 R |
| 4,079,876 | 3/1978 | Malachowski | 226/87 X |

FOREIGN PATENT DOCUMENTS

| | | | |
|---|---|---|---|
| 499455 | 3/1951 | Belgium | 226/87 |
| 2108085 | 2/1971 | Fed. Rep. of Germany | 226/191 |
| 39-19088 | 5/1964 | Japan | 226/191 |

*Primary Examiner*—Stuart S. Levy
*Assistant Examiner*—Lynn M. Sohacki
*Attorney, Agent, or Firm*—Hill, Van Santen, Steadman & Simpson

[57] ABSTRACT

An apparatus for feeding an elongate surface tape or a strip of piled, plushed or tufted textile along a predetermined path has a drive roller which has a multiplicity of wire bristles planted in its surface for releasable engagement with the strip. Disposed upstream of the drive roller with respect to a predetermined traveling direction of the strip, an idler roller is also provided with a multiplicity of wire bristles for releasable engagement with the strip. The idler roller is constantly braked to hold the strip under tension as it extends over the two rollers. The wire bristles on the rollers may be either straight or bent and may either extend radially of the rollers or be inclined in prescribed directions with respect to the traveling direction of the strip.

3 Claims, 8 Drawing Sheets

APPARATUS FOR FEEDING A SURFACE TYPE FASTENER TAPE OR THE LIKE ALONG A PREDETERMINED PATH

BACKGROUND OF THE INVENTION

This invention relates to an apparatus for feeding an elongate tape, strip or band of material, particularly that having a multiplicity of protuberant elements formed thereon, in a predetermined direction along a predetermined path. The apparatus of this invention is perhaps best suited for the feeding, through a desired processing station or stations, of a surface type fastener tape, that is, an elongate carrier tape having a multiplicity of interengageable loops or hooks formed thereon, although the invention is obviously applicable to a similar strip of, for example, piled, plushed or tufted textile as well.

A combination of drive and idler rollers represents the most familiar method of feeding an elongate strip of fabric or like flexible material. The drive roller in particular may have its surface covered with a blanket of rubber or like elastic material for the exertion of greater friction. However, such frictional rollers are not necessarily adaptable for the feeding of an elongate surface type fastener tape or any other strip of fabric or like material having formed thereon a multiplicity of protuberant elements such as pile or tufts. Pressed hard against the roller surfaces while being fed under tension, the tape or strip may have its protuberant elements collapsed and so become a defective product.

Japanese Laid Open Utility Model Application No. 53-78291 suggests a more advanced feed mechanism comprising a drive roller covered with an elastic blanket, and an idler roller covered with animal hair or with bristles of a plastic material such as nylon. The idler roller is held against the drive roller via the strip of piled, plushed or tufted textile to be fed. Problems encountered with this known feed mechanism are that the strip is easy to be destroyed if too much pressure is exerted thereon by the two rollers, and that the protuberant elements on the strip tend to become irregularly oriented if the pressure on the strip is uneven. An even application of just the required degree of pressure by this known mechanism is no easy task.

SUMMARY OF THE INVENTION

The present invention solves the problem of how to feed articles of the class defined without the possibility of collapsing or otherwise ruining the protuberant elements on such articles.

Briefly, the invention provides an apparatus for feeding a surface type fastener tape, or like elongate, flexible strip having a multiplicity of protuberant elements thereon, in a predetermined direction along a predetermined path. Included are a drive roller for forcibly driving a desired strip along the predetermined path, and an idler roller disposed upstream of the drive roller with respect to the predetermined traveling direction of the strip. Both drive roller and idler roller have a multiplicity of wire bristles on their surfaces for releasable engagement with the strip. Brake means are also provided for retarding the rotation of the idler roller as the latter is driven by the drive roller via the strip.

The wire bristles on the drive and idler rollers may be either straight or bent into the shape of a V, generally extending radially of the rollers. Preferably, however, the wire bristles on the drive roller, or the distal portions of these wire bristles if they are bent as above, are each inclined away from a radial direction of the drive roller in a direction opposite to the predetermined traveling direction of the strip. The wire bristles on the idler roller, or the distal portions of these wire bristles if they are bent as aforesaid, are each inclined away from a radial direction of the idler roller in the predetermined traveling direction of the strip.

Pulled by the drive roller, the strip travels over the idler roller, which is being braked by the brake means, in releasable engagement with the wire bristles thereon. There is no likelihood of the protuberant elements on the strip being nonreleasably caught by the bristles on the idler roller, particularly if they are at least partly inclined in the traveling direction of the strip. Then, reaching the drive roller, the strip travels in releasable engagement with the wire bristles thereon, without the possibility of the protuberant elements being collapsed against the drive roller. The protuberant elements will not be ruined in any way by the drive roller, either, particularly if the wire bristles thereon are inclined in the direction opposite to the predetermined traveling direction of the strip.

It is thus seen that the apparatus of this invention is particularly well suited for feeding, through a desired processing station or stations, a surface type fastener tape having loops or hooks thereon, or any other strip of relatively pliant material having protuberant elements such as piles or tufts.

It should also be noted that the drive roller and idler roller are spaced from each other in the apparatus of this invention, instead of being closely held against each other as in the prior art. There is thus eliminated the possibility of the protuberant elements being collapsed between the two rollers. The force necessary for holding the strip against the rollers is obtained by braking the idler roller. Preferably, the brake means include a spring for providing the required braking force, in combination with means for adjustably varying the spring pressure. The spring pressure, and therefore the braking force, is readily adjustable for holding the strip against the rollers under the optimum pressure for the particular strip of material to be fed.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
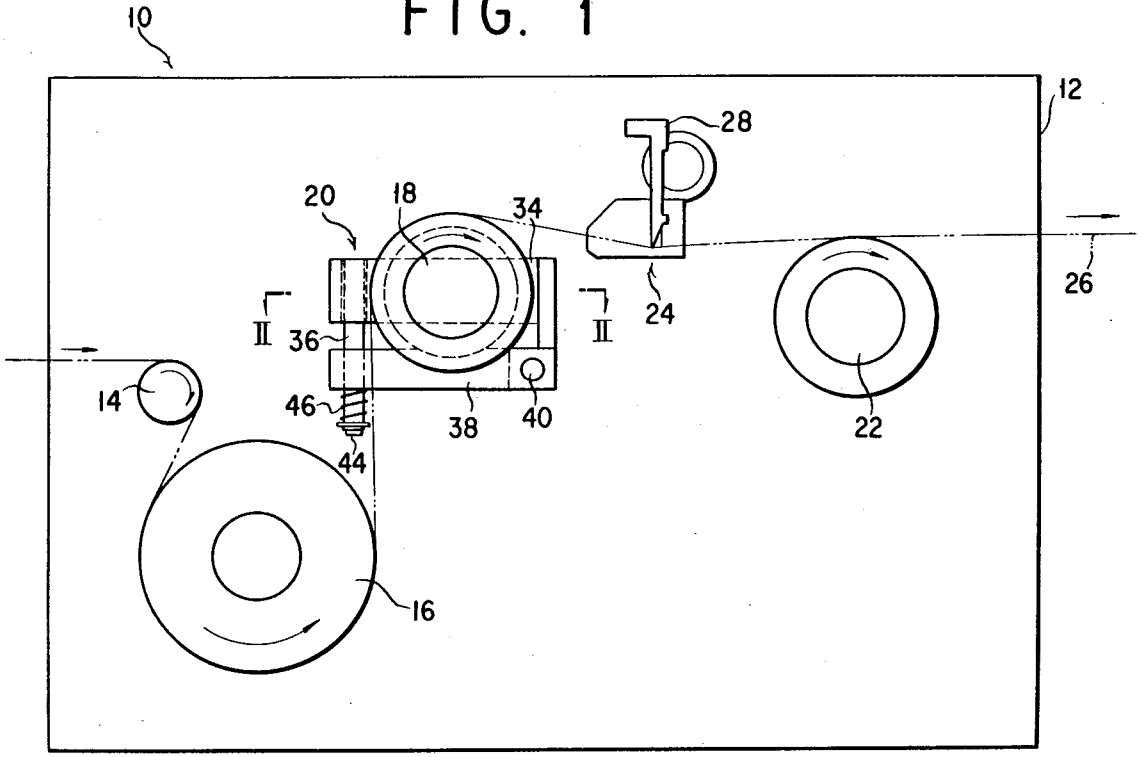
FIG. 1 is a side elevation diagrammatically illustrating apparatus incorporating the novel concepts of this invention for feeding a surface type fastener tape through a coating station, by way of a possible application of the invention.

The present invention will now be described in detail as adapted specifically for feeding an elongate fastener tape through a coating station in the manufacture of surface type fasteners. Generally designated 10 in FIG. 1, the exemplified apparatus has an upstanding support wall 12 on which there are rotatably mounted a small diameter guide roller 14, a large diameter guide roller 16, an idler roller 18 complete with an adjustable brake mechanism 20, and a drive roller 22. All these members are arranged to provide a predetermined path along which the fastener tape 26 is to be fed in a predetermined direction indicated by the arrows. Also mounted on the support wall 12 is a coating mechanism 24 for applying a conventional coating agent to the fastener tape 26 in order to provide a positive anchorage for the loops or hooks on the fastener tape.

The two guide rollers 14 and 16 are arranged in relation to each other so as to reverse the sides of the fastener tape 26 as it travels over these rollers. The idler roller 18 is disposed upstream, with respect to the arrow marked traveling direction of the fastener tape 26, of the drive roller 22 with a spacing therefrom. The invention specifically concerns the improved constructions of these idler roller 18 and drive roller 22, as will be later described in detail.

Disposed between the idler roller 18 and driver roller 22, the coating mechanism 24 is conventionally provided with a doctor blade 28 for forming a uniform film of a coating agent of synthetic resin material on the back of the fastener tape 26, in order that the loops or hooks of the fastener tape may be firmly anchored to the carrier fabric.

Figure 2:
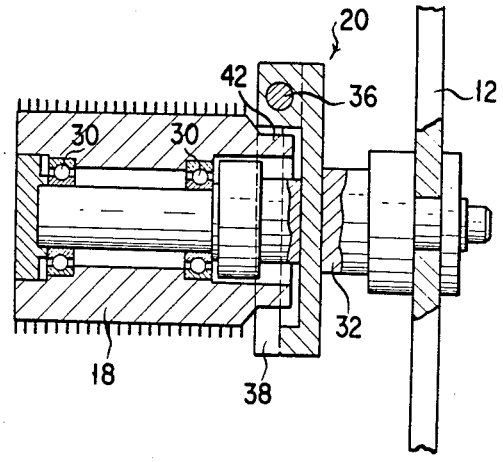
FIG. 2 is an enlarged section through the apparatus of FIG. 1, taken along the line II—II therein and showing in particular the brake means on the idler roller of the apparatus.

Reference is directed also to FIG. 2 for a detailed discussion of the adjustable brake mechanism 20 on the idler roller 18. The idler roller 18 is mounted via bearings 30 on a fixed shaft 32 which is mounted to the support wall 12 in a cantilever fashion. Fixedly mounted on the shaft 32 is an upper brake shoe 34, FIG. 1, generally extending at right angles with the axis of the idler roller 18 and having a guide rod 36 depending from one end thereof. A lower brake shoe 38 is pivoted at one end on a pivot pin 40 which extends parallel to the shaft 32 and which is mounted in fixed relation thereto. The upper and lower brake shoes 34 and 38 slidably engage therebetween a reduced diameter neck portion 42 of the idler roller 18. The free end of the lower brake shoe 38 is bored to permit the guide rod 36 to extend therethrough with substantial clearance. The guide rod 36 has a nut 44 threadedly mounted on its extreme bottom end by way of a spring retainer. Sleeved upon the guide rod 36, a helical compression spring 46 extends between the spring retainer nut 44 and the lower brake shoe 38 and is preloaded by the former for urging the latter against the neck portion 42 of the idler roller 18.

Thus, under pressure from the compression spring 46, the lower brake shoe 38 is urged toward the upper brake shoe 34 and so coacts therewith to retard the rotation of the idler roller 18 by friction. The spring retainer nut 44 may be turned in either direction to vary the preload on the compression spring 46 for the provision of an optimum braking force required for feeding the fastener tape 26.

What follows is a more detailed discussion of the idler roller 18 and drive roller 20 forming the gist of this invention. The idler roller 18 and drive roller 22 are shown on an enlarged scale in FIGS. 3A and 3B and on a still more enlarged scale in FIGS. 4A and 4B, respectively.

Figure 3A:
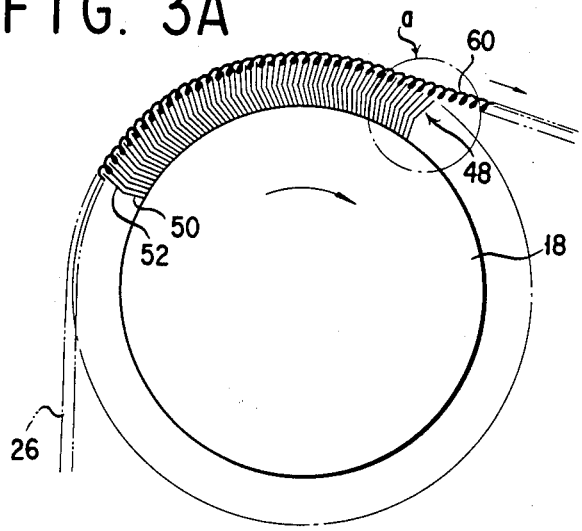
FIG. 3A is an enlarged, diagrammatic elevation of the idler roller in the apparatus of FIG. 1, shown together with the fastener tape traveling thereover.
Figure 4A:
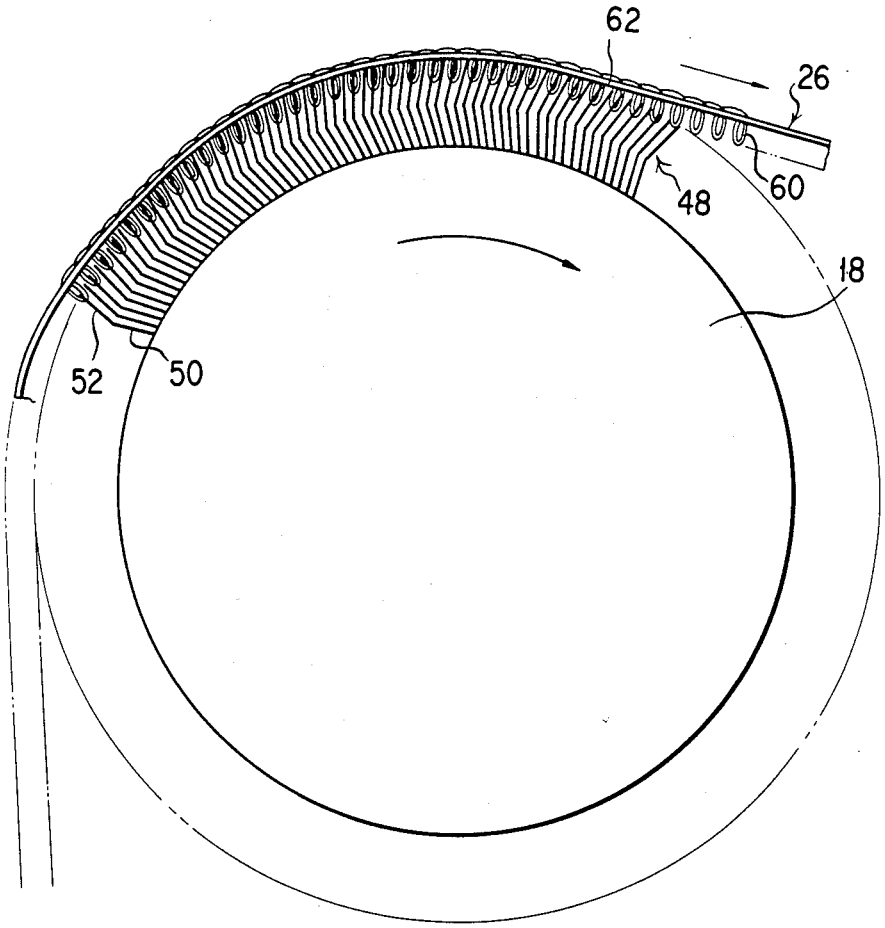
FIG. 4A is a still more enlarged, diagrammatic elevation of the idler roller of FIG. 3A.

With reference to FIGS. 3A and 4A the idler roller 18 has a multiplicity of wire bristles 48 planted in its surface. In this particular embodiment each wire bristle 48 is bent at a midpoint thereof into the shape of a V, providing a proximal portion 50 on the idler roller 18 and a distal portion 52 away therefrom. The proximal portion 50 of each wire bristle 48 is inclinded approximately 15 degrees away from a radial direction of the idler roller 18 in a direction opposite to the traveling direction of the fastener tape 26. The distal portion 52 of each wire bristle 48, on the other hand, is inclined approximately 15 degrees away from a radial direction of the idler roller 18 in the traveling direction of the fastener tape 26. It is the distal portions 52 of the wire bristles 48 that actually engage the fastener tape 26, so that the direction of inclination of these distal portions is more important for effectively feeding the fastener tape in accordance with the novel concepts of this invention.

Figure 3B:
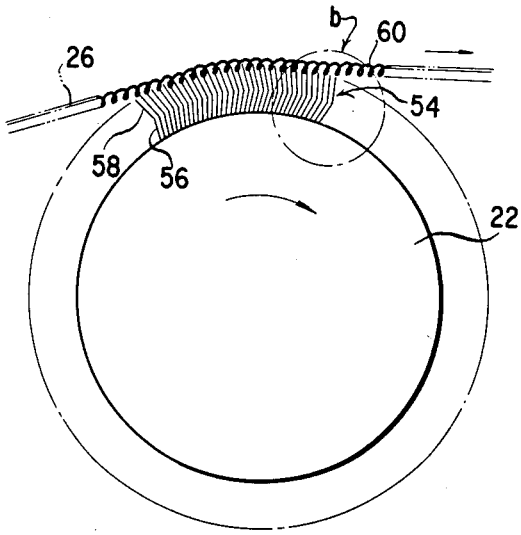
FIG. 3B is an enlarged, diagrammatic elevation of the drive roller in the apparatus of FIG. 1, shown together with the fastener tape traveling thereover.
Figure 4B:
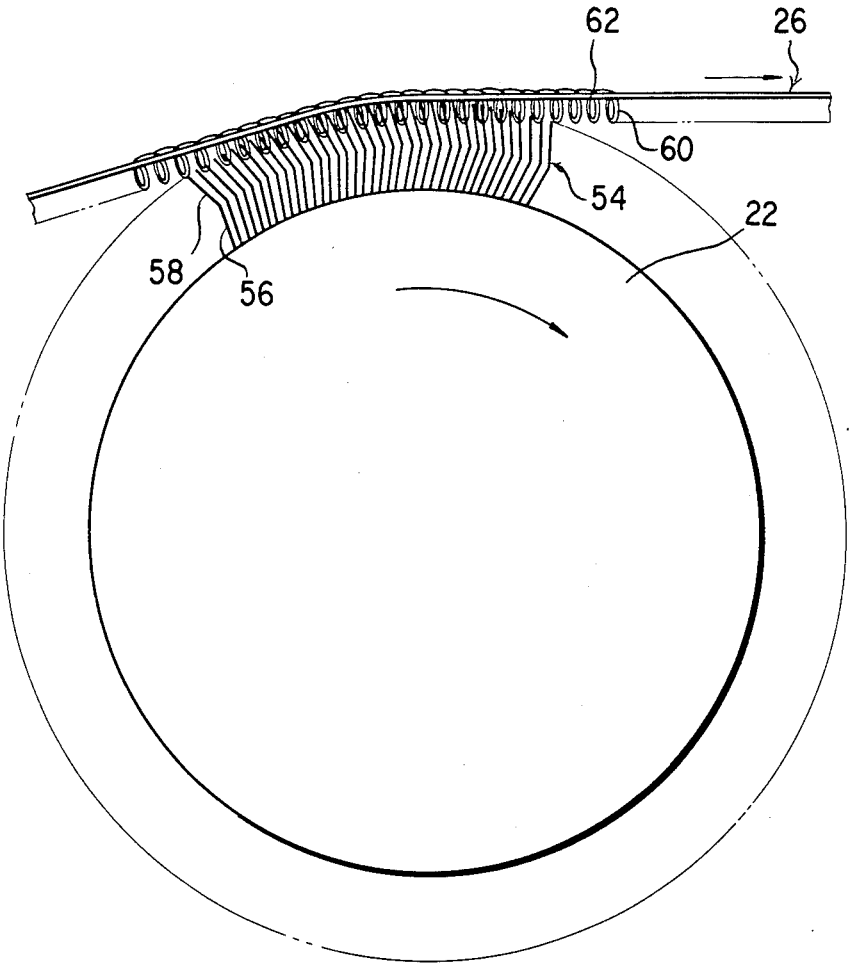
FIG. 4B is a still more enlarged, diagrammatic elevation of the drive roller of FIG. 3B.

As illustrated in FIGS. 3B and 4B, the drive roller 22 also has a multiplicity of wire bristles 54 planted in its surface. Each wire bristle 54 on the drive roller 22 is also shown to be bend at the midpoint thereof to provide a proximal portion 56 on the drive roller and a distal portion 58 away therefrom. The proximal portion 56 of each wire bristle 54 is inclined approximately 15 degrees away from a radial direction of the drive roller 22 in the traveling direction of the fastener tape 26. The distal portion 58 of each wire bristle 54 is inclined approximately 15 degrees away from a radial direction of the drive roller 22 in a direction opposite to the traveling direction of the fastener tape 26.

It is, of course, understood that the noted angles of the distal and proximal portions of the wire bristles 48 and 54 on the idler roller 18 and drive roller 22 are by way of example only. Such angles may be suitably determined in consideration of such factors as the length and concentration of the loops 60 on the carrier fabric 62 of the fastener tape 26, or of the equivalent protuberant elements of any other strip to be fed.

Among the preferred materials of the wire bristles 48 and 54 on the rollers 18 and 22 are stainless steel and tin plated steel. The length of each wire bristle may typically range from 10 to 50 millimeters, and its cross sectional shape may be either circular, polygonal or elliptical. The density of the wire bristles 48 and 54 on the rollers 18 and 22 may usually range from 100 to 500 bristles per square inch (2.54 square centimeters), although other degrees of densities may be employed as required depending upon the cross sectional size of the wire bristles in use and on the concentration of the loops or hooks of the fastener tape 26 or of other protuberant elements of any other strip to be fed. The extreme tips of the wire bristles 48 and 54 may be either pointed, rounded, or blunt ended.

Operation

Pulled by the drive roller 22, the fastener tape 26 travels over the idler roller 18 past the guide rollers 14 and 16, with the loops 60 of the fastener tape directed toward the idler roller. These loops are engaged by the wire bristles 48 on the idler roller 18, causing the latter to revolve in a clockwise direction as viewed in FIGS. 3A and 4A against the force of the adjustable brake mechanism 20. At the point on the idler roller 18, indicated by the dashed circle designated a in FIG. 3A, where the fastener tape 26 comes off the idler roller, the wire bristles 48 will smoothly disengage the fastener tape loops 60 because the distal portions 52 of the wire bristles are inclined in the traveling direction of the fastener tape and because the idler roller is constantly braked.

It is to be appreciated that the possibility of the wire bristles 48 piercing and so ruining the carrier fabric 62 of the fastener tape 26 by angling their distal portions 52 in the traveling direction of the fastener tape. Should the distal portions 52 of the wire bristles 48 on the idler roller 18 be inclined away from the traveling direction of the fastener tape 26, they would fail to release the fastener tape loops 60 at the point a of FIG. 3A because of the braking of the idler roller 18, thereby making the tape a defective product that must be rejected.

The braking of the idler roller 18 is effective to prevent it from rotating faster than the feeding speed of the fastener tape 26, that is, its overspeed rotation and to hold the fastener tape 26 under proper tension as it travels from the idler roller 18 to the drive roller 22.

Traveling as above from the idler roller 18 toward the drive roller 22, the fastener tape 26 passes the coating mechanism 24. The doctor blade 28 of this mechanism applies the standard coating agent to the back of the fastener tape 26 in order to make the loops 60 positively anchored to the carrier fabric 62.

The wire bristles 54 on the drive roller 22 also engage the loops 60 of the fastener tape 26 for positively driving the tape in opposition to the braking force on the idler roller 18. Since the distal portions 58 of the wire bristles are inclined away from the traveling direction of the fastener tape 26, they smoothly withdraw from the loops 60 of the fastener tape at b in FIG. 3B, without the least possibility of ruining the loops or their carrier fabric in so doing.

Alternative Embodiments

Figure 5A:
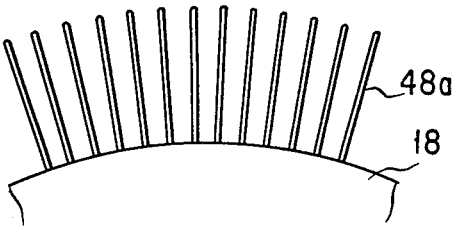
FIG. 5A is a fragmentary, diagrammatic elevation of another preferred form of the idler roller in accordance with the invention.
Figure 5B:
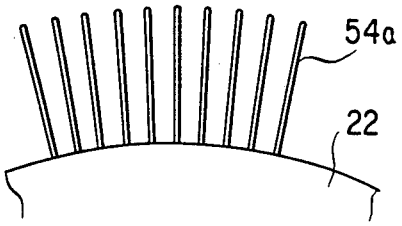
FIG. 5B is a fragmentary, diagrammatic elevation of another preferred form of the drive roller in accordance with the invention.

The wire bristles 48 and 54 on the idler roller 18 and drive roller 22 can take various forms other than those disclosed in the foregoing embodiment within the broad teaching hereof. As shown in FIGS. 5A and 5B, the idler roller 18 and drive roller 22 may both be provided with straight wire bristles **48*a* and 54*a***, respectively, which extend radially of the rollers. These rollers are particularly useful in feeding surface type fastener tapes having hooks formed thereon for engagement with the loops of the complementary fastener tapes disclosed in the above embodiment.

Figure 6A:
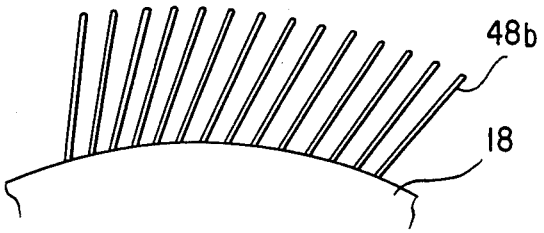
FIG. 6A is a fragmentary, diagrammatic elevation of still another preferred form of the idler roller in accordance with the invention.
Figure 6B:
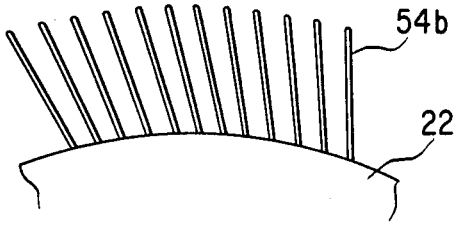
FIG. 6B is a fragmentary, diagrammatic elevation of still another preferred form of the drive roller in accordance with the invention.

FIGS. 6A and 6B also show straight wire bristles **48*b* and 54*b* on the idler roller 18 and drive roller 22, respectively. However, the wire bristles 48*b* on the idler roller 18 are all inclined in the traveling direction of the strip being fed. The wire bristles 54*b* on the drive roller 22** are all inclined in a direction opposite to the traveling direction of the strip.

Figure 7A:
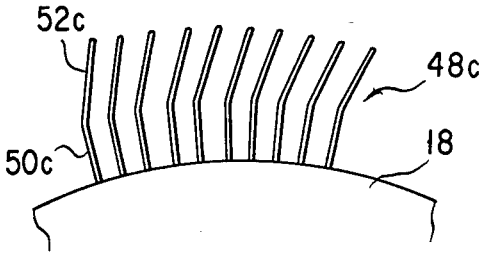
FIG. 7A is a fragmentary, diagrammatic elevation of a further preferred form of the idler roller in accordance with the invention.
Figure 7B:
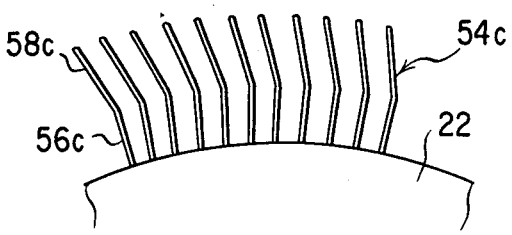
FIG. 7B is a fragmentary, diagrammatic elevation of a further preferred form of the drive roller in accordance with the invention.

The wire bristles **48*c* and 54*c* on the idler roller 18 and drive roller 22 shown in FIGS. 7A and 7B, respectively, are each bent in the middle like the bristles 48 and 54 of the first disclosed embodiment. However, the proximal portions 50*c* and 56*c* of these wire bristles extend radially of the rollers 18 and 22. Only the distal portions 52*c* of the wire bristles 48*c* on the idler roller 18 are inclined in the traveling direction of the strip being fed, whereas the distal portions 58*c* of the wire bristles 54*c* on the drive roller 22** are inclined away from the traveling direction of the strip.

Additional modifications or alterations of the illustrated embodiments may be resorted to without departing from the scope of this invention.

What is claimed is:

1. An apparatus for feeding a surface type fastener tape, or like elongate, flexible strip having a multiplicity of protuberant elements thereon, in a predetermined direction along a predetermined path, comprising:

(a) a drive roller for forcibly driving a desired strip along the predetermined path, the drive roller having a multiplicity of wire bristles on its surface for releasable engagement with the strip, each wire bristle on the drive roller being bent at a midpoint thereof to provide a proximal portion on the drive roller and a distal portion away therefrom, wherein the proximal portion of each wire bristle on the drive roller is inclined away from a radial direction of the drive roller in the predetermined traveling direction of the strip, and wherein the distal portion of each wire bristle on the drive roller is inclined away from a radial direction of the drive roller in a direction opposite to the predetermined traveling direction of the strip;

(b) an idler roller disposed upstream of the driver roller with respect to the predetermined traveling direction of the strip, the idler roller also having a multiplicity of wire bristles on its surface for releasable engagement with the strip, each wire bristle on the idler roller being bent at a midpoint thereof to provide a proximal portion on the idler roller and a distal portion away therefrom, wherein the proximal portion of each wire bristle on the idler roller is inclined away from a radial direction of the idler roller in a direction opposite to the predetermined traveling direction of the strip, and wherein the distal portion of each wire bristle on the idler roller is inclined away from a radial direction of the idler roller in the predetermined traveling direction of the strip; and (c) brake means for retarding the rotation speed of the idler roller to less than a traveling speed of the strip as the idler roller is driven by the drive roller via the strip.

2. An apparatus for feeding a surface type fastener tape, or like elongate, flexible strip having a multiplicity of protuberant elements thereon, in a predetermined direction long a predetermined path, comprising:

(a) a driver roller for forcibly driving a desired strip along the predetermined path, the drive roller having a multiplicity of wire bristles on its surface for releasable engagement with the strip, each wire bristle on the drive roller being bent at a midpoint thereof to provide a proximal portion on the drive roller and a distal portion away therefrom, wherein the proximal portion of each wire bristle on the drive roller extend radially of the drive roller, and wherein the distal portion of each wire bristle on the drive roller is inclined away from a radial direction of the drive roller in a direction opposite to the predetermined traveling direction of the strip;

(b) an idler roller disposed upstream of the drive roller with respect to the predetermined traveling direction of the strip, the idler roller also having a multiplicity of wire bristles on its surface for releasable enagement with the strip; and (c) brake means for retarding the rotation speed of the idler roller to less than a traveling speed of the strip as the idler roller is driven by the drive roller via the strip.

3. The apparatus of claim 2 wherein each wire bristle on the idler roller is bent at a midpoint thereof to provide a proximal portion on the idler roller and a distal portion away therefrom, wherein the proximal portion of each wire bristle on the idler roller extend radially of the idler roller, and wherein the distal portion of each wire bristle on the idler roller is inclined away from a radial direction of the idler roller in the predetermined traveling direction of the strip.

* * * * *